US008445417B2

(12) United States Patent
Baker et al.

(10) Patent No.: US 8,445,417 B2
(45) Date of Patent: May 21, 2013

(54) LUBRICATING COMPOSITION CONTAINING BORATED PHOSPHOLIPID

(75) Inventors: Mark R. Baker, Lyndhurst, OH (US); Gabriel B. Rhoads, Gates Mills, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 171 days.

(21) Appl. No.: 12/743,837

(22) PCT Filed: Nov. 21, 2008

(86) PCT No.: PCT/US2008/084256

§ 371 (c)(1), (2), (4) Date: Aug. 25, 2010

(87) PCT Pub. No.: WO2009/073390

PCT Pub. Date: Jun. 11, 2009

(65) Prior Publication Data

US 2010/0323935 A1 Dec. 23, 2010

Related U.S. Application Data

(60) Provisional application No. 60/992,738, filed on Dec. 6, 2007.

(51) Int. Cl.
*C10M 163/00* (2006.01)
*C10L 1/22* (2006.01)

(52) U.S. Cl.
USPC ..... 508/186; 508/189

(58) Field of Classification Search
USPC ..... 508/186, 189
See application file for complete search history.

(56) References Cited

U.S. PATENT DOCUMENTS

| | | | | |
|---|---|---|---|---|
| 3,284,409 | A | 11/1966 | Dorer | |
| 3,825,495 | A | 7/1974 | Newingham et al. | |
| 4,180,466 | A | 12/1979 | Newingham et al. | |
| 5,135,669 | A | 8/1992 | Brois et al. | |
| 5,487,838 | A * | 1/1996 | Luciani et al. | 508/188 |
| 5,547,586 | A | 8/1996 | Halperin et al. | |
| 5,767,044 | A | 6/1998 | Bigelow et al. | |
| 5,843,873 | A * | 12/1998 | Butke et al. | 508/185 |
| 6,528,458 | B1 * | 3/2003 | Tagliamonte et al. | 508/185 |
| 2002/0119895 | A1 | 8/2002 | Cook et al. | |
| 2007/0225182 | A1 * | 9/2007 | Hewette | 508/564 |

FOREIGN PATENT DOCUMENTS

| | | |
|---|---|---|
| EP | 0459656 | 12/1991 |
| EP | 0628623 | 12/1994 |
| EP | 1840194 | 3/2007 |
| EP | 0399764 | 5/2010 |
| WO | 96/37585 | 11/1996 |

OTHER PUBLICATIONS

Corresponding PCT Publication 2009/073390 A1, including the PCT Search Report, published Jun. 11, 2009.

Written Opinion of corresponding PCT International Application No. PCT/US2008/084256 mailed Feb. 6, 2009.

* cited by examiner

*Primary Examiner* — Prem C Singh
*Assistant Examiner* — Francis C Campanell
(74) *Attorney, Agent, or Firm* — Michael F. Esposito; David M. Shold

(57) ABSTRACT

The invention relates to a lubricating composition containing (a) a borated phospholipid, (b) an amine salt of a phosphoric acid ester, and (c) an oil of lubricating viscosity. The invention further provides for the use of the lubricating composition for lubricating a limited slip differential.

12 Claims, No Drawings

LUBRICATING COMPOSITION CONTAINING BORATED PHOSPHOLIPID

FIELD OF INVENTION

The invention relates to a lubricating composition containing (a) a borated phospholipid, (b) an amine salt of a phosphoric acid ester, and (c) an oil of lubricating viscosity. The invention further provides for the use of the lubricating composition for lubricating a limited slip differential.

BACKGROUND OF THE INVENTION

A limited slip differential in a vehicle typically employs a wet multi-plate clutch i.e., clutch plates are immersed in a lubricant. The limited slip differential typically has bevel gear or spur gear planetary systems which distribute the drive torque evenly to the two driving wheels irrespective of their rotational speed. This makes it possible for the driven wheels to roll during cornering without slip between the wheel and road surface in spite of their different rotational speed. In order for the slip to be controlled lubricants containing compounds capable of improving friction performance, dispersants and sulphur- and/or phosphorus-containing extreme pressure agents may be used. Examples of lubricants of this type are disclosed in U.S. Pat. Nos. 5,547,586; 4,180,466; 3,825,495; and European Patent Application 0 399 764 A1.

Lubricants containing compounds suitable for (i) deposit control (U.S. Pat. No. 3,284,409), and (ii) wear performance are described in International Application WO 96/037585, US Patent Application 2002/0119895, and U.S. Pat. No. 5,487,838.

U.S. Pat. No. 5,487,838 discloses a reaction product of a boron compound and a phospholipid. The reaction product may be used in a number of lubricants including an automatic transmission fluid, a gear oil, or a tractor fluid.

U.S. Pat. No. 5,135,669 discloses a lubricant composition containing a hydrogenated phospholipid (including hydrogenated lecithin, an antioxidant, a dispersant, a seal swell agent, an antiwear agent and a viscosity modifier. The hydrogenated phospholipid may also be reacted with a metal.

US Patent Application 2002/0119895 discloses (A) a molybdenum compound, and (B) a specific composition selected from (i) at least one borated overbased metal salt of acidic organic compounds, (ii) a combination of (a) at least one organic polysulfide or at least one ashless dithiocarbamate containing composition, and (b) at least one of metal thiophosphate, phosphate, P-containing compound of carboxylate, ester, ether or amide, borated dispersant, alkali metal borate, borated fatty amine, borated phospholipid, and their mixtures, and (iii) a combination of (i) and (ii). The lubricant composition is used to lubricate transmission and differential gears.

International Application WO 96/037585 discloses lubricant compositions containing (A) an antiwear improving amount of at least one molybdenum containing composition, and (B) at least one member selected from the group consisting of (i) at least one borated overbased metal salt of an acidic organic compound, provided that (A) and (Bi) are not the same, (ii) a combination of (a) at least one organic polysulfide or at least one ashless dithiocarbamate containing composition and (b) at least one component selected from the group consisting of a metal thiophosphate, a phosphoric acid ester or salt thereof, a phosphorus-containing carboxylic acid, ester, ether, or amide, a borated dispersant, an alkali metal borate, a borated fatty amine, a borated phospholipid, a borate ester, and mixtures thereof, and (iii) a combination of (i) and (ii). The lubricant includes 80W and 80W-90 gear oils.

U.S. Pat. No. 3,284,409 discloses an additive for hydrocarbon oils and lubricants containing a composition of component (A) a product obtained by the reaction of a succinic acid substituted by an aliphatic hydrocarbon with greater than 50 carbon atoms with greater than 0.5 equivalent of alkylene amine (ethylene amine (I), polyethylene polyamine) and with greater than 0.1 equivalent boron acids, their esters, or ammonium salts, or $B_2O_3$, and component (B) lipid phosphatides, such as lecithin. The lubricants may be useful for internal combustion engines, gear assemblies and power transmitting units. The example discloses use in an internal combustion engine.

U.S. Pat. No. 5,135,669 discloses hydrogenated, phospholipid compounds suitable as friction modifying materials that are employed in automatic transmission fluids.

SUMMARY OF THE INVENTION

The inventors of this invention have discovered that a lubricating composition and method as disclosed herein is capable of providing an acceptable level of at least one of (i) lubricant thermal stability, (ii) lubricant oxidative stability, (iii) high static coefficient of friction, (iv) fuel economy, (v) deposit control, (vi) seal compatibility, and (vii) low tendency towards noise, vibration and harshness (NVH) often manifested as chatter (i.e. an abnormal noise typically referred to as a low-frequency "growl" and "groan", particularly during higher-speed cornering manoeuvres). The inventors have also unexpectedly discovered that the lubricant composition and method disclosed herein may also be suitable for limited slip systems having one or more distinct plate materials. For example the plate materials may be steel, paper, ceramic, carbon fibers and systems employing a mixture of plate types such as steel on ceramic, carbon fibers in paper or steel on paper.

In one embodiment, the invention provides a lubricating composition comprising (a) a borated phospholipid, (b) an amine salt of a phosphoric acid ester, and (c) an oil of lubricating viscosity.

In one embodiment, the invention provides a method of lubricating a limited slip differential comprising supplying to the limited slip differential a lubricating composition comprising (a) a borated phospholipid, (b) an amine salt of a phosphoric acid ester, and (c) an oil of lubricating viscosity.

In one embodiment, the invention provides for the use of a lubricating composition comprising (a) a borated phospholipid, (b) an amine salt of a phosphoric acid ester, and (c) an oil of lubricating viscosity in a limited slip differential to provide an acceptable level of at least one of (i) lubricant thermal stability, (ii) lubricant oxidative stability, (iii) friction coefficients, (iv) fuel economy, (v) deposit control, (vi) seal compatibility, and (vii) chattering (abnormal noise).

DETAILED DESCRIPTION OF THE INVENTION

The present invention provides a lubricating composition and method as disclosed herein above.

Borated Phospholipid

The phospholipid may be any lipid containing a phosphoric acid, such as lecithin or cephalin, or derivatives thereof. Examples of phospholipids include phosphatidylcholine, phosphatidylserine, phosphatidylinositol, phosphatidylethanolamine, phosphotidic acid and mixtures thereof. The phospholipids may be glycerophospholipids, glycero derivatives of the above list of phospholipids. Typically, the glycerophospholipids have one or two acyl, alkyl or alkenyl groups on a glycerol residue. The alkyl or alkenyl groups may contain 8 to 30, or 8 to 25, or 12 to 24 carbon atoms. Examples of suitable alkyl or alkenyl groups include octyl, dodecyl, hexadecyl, octadecyl, docosanyl, octenyl, dodecenyl, hexadecenyl and octadecenyl. In one embodiment the phospholipid is lecithin, or derivatives thereof.

The acyl groups on the glycerophospholipids may be derived from fatty acids. The fatty acids may contain 8 to 30, or 12 to 24, or 12 to 18 carbon atoms. Examples of fatty acids include myristic, palmitic, stearic, oleic, linoleic, linolenic, arachidic, arachidonic acids, or mixtures thereof.

In one embodiment the fatty acid may be stearic, oleic, linoleic acids, or mixtures thereof.

Derivatives of phospholipids may be acylated or hydroxylated phospholipids. For example, lecithin as well as acylated and hydroxylated lecithins may be used in the present invention. Acylated lecithins may be prepared by reacting an acylating agent with a lecithin. Acylating agents include acetic acid. An example of a commercially available acylated lecithin is Thermolec 200™ acylated soya lecithin (available from Ross & Rowe, Inc. of Decatur, Ill.). Hydroxylated lecithins may also be used. Hydroxylated lecithins may be prepared by acidic or enzymatic hydrolysis. An example of hydroxylated lecithins is Thermolec 1018™ hydroxylated lecithin commercially available from Ross & Rowe, Inc.

Phospholipids may be prepared synthetically or derived from natural sources. Synthetic phospholipids may be prepared by methods known to those in the art. Naturally derived phospholipids are often extracted by procedures known to those in the art. Phospholipids may be derived from animal or vegetable sources. The animal sources include fish, fish oil, shellfish, bovine brain or any egg, or chicken eggs. Vegetable sources include rapeseed, sunflower seed, peanut, palm kernel, cucurbit seed, wheat, barley, rice, olive, mango, avocado, palash, papaya, jangli, bodani, carrot, soybean, corn, and cottonseed, and commonly soybean, corn, sunflower and cottonseed. Phospholipids may be derived from microorganisms, including blue-green algae, green algae, bacteria grown on methanol or methane and yeasts grown on alkanes.

A useful phospholipid is derived from sunflower seeds. The phospholipid typically contains 35% to 60% phosphatidylcholine, 20% to 35% phosphatidylinositol, 1% to 25% phosphatidic acid, and 10% to 25% phosphatidylethanolamine, wherein the percentages are by weight based on the total phospholipids. The fatty acid content may be 20 wt % to 30 wt % by weight palmitic acid, 2 wt % to 10 wt % stearic acid, 15 wt % to 25 wt % oleic acid, and 40 wt % to 55 wt % linoleic acid.

In one embodiment, the phospholipid is derived from high oleic content sunflower seeds. These seeds typically produce phospholipids having oleic content greater than 75 wt %, or 80 wt % or more, or 85 wt % or more. The fatty acid content of phospholipids derived from high oleic sunflower seeds generally includes 3.5 wt % to 4.5 wt % palmitic acid, 3 wt % to 5.5 wt % stearic acid, 75 wt % to 95 wt % oleic acid, and 5 wt % to 15 wt % linoleic acid.

Phospholipids and lecithins are described in detail in Encyclopedia of Chemcial Technology, Kirk and Othmer, 3rd Edition, in "Fats and Fatty Oils", Volume 9, pages 795-831 and in "Lecithins", Volume 14, pages 250-269.

Boronation of the phospholipids may be carried out by reaction with boron compounds. The boron compounds include boron oxide, boron oxide hydrate, boron trioxide, boron trifluoride, boron tribromide, boron trichloride, boron acids such as boronic acid (i.e., alkyl-$B(OH)_2$ or aryl-$B(OH)_2$), boric acid (i.e., $H_3BO_3$), tetraboric acid (i.e., $H_2B_4O_7$), metaboric acid (i.e., $HBO_2$), boron anhydrides, boron amides and various esters of such boron acids. The use of complexes of boron trihalide with ethers, organic acids, inorganic acids, or hydrocarbons may also be utilised as a convenient means of introducing the boron reactant into the reaction mixture. Such complexes are known and are exemplified by boron-trifluoride-triethyl orthoester, boron trifluoride-phosphoric acid, boron trichloride-chloroacetic acid, boron tribromide-dioxane, and boron trifluoridemethyl ethyl ether complexes.

Examples of boronic acid include methyl boronic acid, phenyl-boronic acid, cyclohexyl boronic acid, p-heptylphenyl boronic acid and dodecyl boronic acid, or mixtures thereof.

A more detailed description and methods of preparation of borated phospholipids is described in U.S. Pat. No. 5,487,838. Examples 1 to 7 as disclosed in column 20 line 64 to column 22 line 51 of U.S. Pat. No. 5,487,838 exemplify the preparation borated phospholipids.

Amine Salt of a Phosphoric Acid Ester

The amine salt of a phosphoric acid ester may contain ester groups each having 1 to 30, 6 to 30, 8 to 30, 10 to 24 or 12 to 20, or 16 to 20 carbon atoms, with the proviso that a portion or all of ester groups are sufficiently long to solubilise the amine salt of a phosphoric acid ester in an oil of lubricating viscosity. Typically ester groups containing 4 or more carbon atoms are particularly useful.

Examples of suitable ester groups include isopropyl, methyl-amyl (may also be referred to as 4-methyl-2-pentyl), 2-ethylhexyl, heptyl, octyl, nonyl, decyl dodecyl, butadecyl, pentadecyl, hexadecyl, heptadecyl, octadecyl, nonadecyl, eicosyl, or mixtures thereof.

In one embodiment the ester groups are selected from the group consisting of isopropyl, methyl-amyl (may also be referred to as 4-methyl-2-pentyl), 2-ethylhexyl, heptyl, octyl, nonyl, decyl, and mixtures thereof.

The amines which may be suitable for use as the amine salt include primary amines, secondary amines, tertiary amines, and mixtures thereof. The amines include those with at least one hydrocarbyl group, or, in certain embodiments, two or three hydrocarbyl groups. The hydrocarbyl groups may contain 2 to 30 carbon atoms, or in other embodiments 8 to 26, or 10 to 20, or 13 to 19 carbon atoms.

Primary amines include ethylamine, propylamine, butylamine, 2-ethylhexylamine, octylamine, and dodecylamine, as well as linear amines as n-octylamine, n-decylamine, n-dodecylamine, n-tetradecylamine, n-hexadecylamine, n-octadecylamine and oleyamine. Other useful fatty amines include commercially available fatty amines such as "Armeen®" amines (products available from Akzo Chemicals, Chicago, Ill.), such as Armeen C, Armeen O, Armeen O L, Armeen T, Armeen H T, Armeen S and Armeen S D, wherein the letter designation relates to the fatty group, such as coco, oleyl, tallow, or stearyl groups.

Examples of suitable secondary amines include dimethylamine, diethylamine, dipropylamine, dibutylamine, diamylamine, dihexylamine, diheptylamine, methylethylamine, ethylbutylamine and ethylamylamine. The secondary amines may be cyclic amines such as piperidine, piperazine and morpholine.

The amine may also be a tertiary-aliphatic primary amine. The aliphatic group in this case may be an alkyl group containing 2 to 30, or 6 to 26, or 8 to 24 carbon atoms. Tertiary alkyl amines include monoamines such as tert-butylamine, tert-hexylamine, 1-methyl-1-amino -cyclohexane, tert-octylamine, tert-decylamine, tertdodecylamine, tert-tetradecylamine, tert-hexadecylamine, tert-octadecylamine, tert-tetracosanylamine, and tert-octacosanylamine.

The amine salt of a phosphorus acid ester may be a reaction product of a $C_{12-20}$ alkylated phosphoric acid with a tertiary $C_{11-22}$ alkyl primary amine.

In one embodiment the amine salt of a phosphorus acid ester includes an amine with C11 to C14 tertiary alkyl primary groups or mixtures thereof. In one embodiment the amine salt of a phosphorus compound includes an amine with C14 to C18 tertiary alkyl primary amines or mixtures thereof. In one embodiment the amine salt of a phosphorus compound includes an amine with C18 to C22 tertiary alkyl primary amines or mixtures thereof.

In one embodiment the amine salt of a phosphorus acid ester includes the reaction product of octadecenyl phosphoric acid with Primene 81R™.

Mixtures of amines may also be used in the invention. In one embodiment a useful mixture of amines is "Primene™ 81R" and "Primene™ JMT." Primene™ 81R and Primene™ JMT (both produced and sold by Rohm & Haas) are mixtures of C11 to C14 tertiary alkyl primary amines and C18 to C22 tertiary alkyl primary amines respectively.

In one embodiment the amine salt of a phosphorus acid ester is the reaction product of a C14 to C18 alkylated phosphoric acid with Primene 81R™ (produced and sold by Rohm & Haas) which is a mixture of C11 to C14 tertiary alkyl primary amines.

Examples of the amine salt of a phosphorus acid ester include the reaction product(s) of isopropyl, methyl-amyl (4-methyl-2-pentyl or mixtures thereof), 2-ethylhexyl, heptyl, octyl, nonyl or decyl dithiophosphoric acids with ethylene diamine, morpholine, or Pimene 81R™, and mixtures thereof.

Examples of the amine salt of a phosphorus acid ester include the reaction product(s) of butadecyl, pentadecyl, hexadecyl, heptadecyl, octadecyl, nonadecyl or eicosyl dithiophosphoric acids with ethylene diamine, morpholine, or Primene 81R™, and mixtures thereof. In one embodiment the amine salt of a phosphorus acid ester includes the reaction product of octadecenyl dithiophosphoric acid with Primene 81R™

Weight Ranges of Amine Salt of a Phosphorus Acid Ester and Borated Phospholipid

The borated phospholipid may be present at 0.05 wt % to 6 wt %, or 0.5 wt % to 3 wt % of the lubricating composition.

The amine salt of a phosphorus acid ester may be present at 0.01 wt % to 5 wt %, or 0.01 wt % to 2 wt %, or 0.25 wt % to 1 wt % of the lubricating composition.

In one embodiment the amine salt of a phosphoric acid ester is present at 10 wt % to 50 wt % of the total combined amount of (a) and (b); and the borated phospholipid is present at 50 wt % to 90 wt % of the total combined amount of (a) and (b).

In one embodiment the amine salt of a phosphoric acid ester is present at 25 wt % to 40 wt % of the total combined amount of (a) and (b); and the borated phospholipid is present at 60 wt % to 75 wt % of the total combined amount of (a) and (b).

Oils of Lubricating Viscosity

The lubricating composition comprises an oil of lubricating viscosity. Such oils include natural and synthetic oils, oil derived from hydrocracking, hydrogenation, and hydrofinishing, unrefined, refined and re-refined oils and mixtures thereof.

Unrefined oils are those obtained directly from a natural or synthetic source generally without (or with little) further purification treatment.

Refined oils are similar to the unrefined oils except they have been further treated in one or more purification steps to improve one or more properties. Purification techniques are known in the art and include solvent extraction, secondary distillation, acid or base extraction, filtration, percolation and the like.

Re-refined oils are also known as reclaimed or reprocessed oils, and are obtained by processes similar to those used to obtain refined oils and often are additionally processed by techniques directed to removal of spent additives and oil breakdown products.

Natural oils useful in making the inventive lubricants include animal oils, vegetable oils (e.g., castor oil, lard oil), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerised and interpolymerised olefins (e.g., polybutylenes, polypropylenes, propyleneisobutylene copolymers); poly(1-hexenes), poly(1-octenes), poly(1-decenes), and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); alkylated diphenyl ethers and alkylated diphenyl sulphides and the derivatives, analogs and homologs thereof or mixtures thereof.

Other synthetic lubricating oils include polyol esters (such as Prolube®3970), diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in the American Petroleum Institute (API) Base Oil Interchangeability Guidelines. The five base oil groups are as follows: Group I (sulphur content >0.03 wt %, and/or <90 wt % saturates, viscosity index 80-120); Group II (sulphur content ≦0.03 wt %, and ≧90 wt % saturates, viscosity index 80-120); Group III (sulphur content ≦0.03 wt %, and ≧90 wt % saturates, viscosity index ≧120); Group IV (all polyalphaolefins (PAOs)); and Group V (all others not included in Groups I, II, III, or IV). The oil of lubricating viscosity includes an API Group I, Group II, Group III, Group IV, Group V oil or mixtures thereof. Often the oil of lubricating viscosity is an API Group I, Group II, Group III, Group IV oil or mixtures thereof. Alternatively the oil of lubricating viscosity is often an API Group II, Group III or Group IV oil or mixtures thereof.

The amount of the oil of lubricating viscosity present is typically the balance remaining after subtracting from 100 wt % the sum of the amount of the borated phospholipid, the amine salt of a phosphoric acid ester, and, and the other performance additives.

The lubricating composition may be in the form of a concentrate and/or a fully formulated lubricant. If the lubricating composition disclosed herein, is in the form of a concentrate (which may be combined with additional oil to form, in whole or in part, a finished lubricant), the ratio of the of components of the lubricating composition, to the oil of lubricating viscosity and/or to diluent oil include the ranges of 1:99 to 99:1 by weight, or 80:20 to 10:90 by weight. When in the form of a concentrate, the present invention may be part of a full lubricant composition, or may be a supplemental additive package or "top treat".

Other Performance Additives

The composition of the invention optionally further includes at least one other performance additive. The other performance additives include dispersants, metal deactivators, detergents, viscosity modifiers, extreme pressure agents (typically boron- and/or sulphur- and/or phosphorus-containing), antiwear agents, antioxidants (such as hindered phenols, aminic antioxidants or molybdenum compounds), corrosion inhibitors, foam inhibitors, demulsifiers, pour point depressants, seal swelling agents and mixtures thereof.

The total combined amount of the other performance additives (excluding the viscosity modifiers) present on an oil free basis may include ranges of 0 wt % to 25 wt %, or 0.01 wt % to 20 wt %, or 0.1 wt % to 15 wt % or 0.5 wt % to 10 wt %, or 1 to 5 wt % of the composition. Although one or more of the other performance additives may be present, it is common for the other performance additives to be present in different amounts relative to each other.

In one embodiment the lubricating composition is free of molybdenum-containing additives.

Viscosity Modifiers

In one embodiment the lubricating composition further includes one or more viscosity modifiers.

When present the viscosity modifier may be present in an amount of 0.5 wt % to 70 wt %, 1 wt % to 60 wt %, or 5 wt % to 50 wt %, or 10 wt % to 50 wt % of the lubricating composition.

Viscosity modifiers include (a) polymethacrylates, (b) esterified copolymers of (i) a vinyl aromatic monomer and (ii) an unsaturated carboxylic acid, anhydride, or derivatives thereof, (c) esterified interpolymers of (i) an alpha-olefin; and (ii) an unsaturated carboxylic acid, anhydride, or derivatives thereof, or (d) hydrogenated copolymers of styrene-butadiene, (e) ethylene-propylene copolymers, (f) polyisobutenes, (g) hydrogenated styrene-isoprene polymers, (h) hydrogenated isoprene polymers, or (i) mixtures thereof.

In one embodiment the viscosity modifier includes (a) a polymethacrylate, (b) an esterified copolymer of (i) a vinyl aromatic monomer; and (ii) an unsaturated carboxylic acid, anhydride, or derivatives thereof, (c) an esterified interpolymer of (i) an alpha-olefin; and (ii) an unsaturated carboxylic acid, anhydride, or derivatives thereof, or (d) mixtures thereof.

Extreme Pressure Agents

Extreme pressure agents include compounds containing boron and/or sulphur and/or phosphorus.

The extreme pressure agent may be present in the lubricating composition at 0 wt % to 20 wt %, or 0.05 wt % to 10 wt %, or 0.1 wt % to 8 wt % of the lubricating composition.

In one embodiment the extreme pressure agent is a sulphur-containing compound. In one embodiment the sulphur-containing compound is a sulphurised olefin, a polysulphide, or mixtures thereof.

Examples of the sulphurised olefin include an olefin derived from propylene, isobutylene, pentene, an organic sulphide and/or polysulphide including benzyldisulphide; bis-(chlorobenzyl) disulphide; dibutyl tetrasulphide; di-tertiary butyl polysulphide; and sulphurised methyl ester of oleic acid, a sulphurised alkylphenol, a sulphurised dipentene, a sulphurised terpene, a sulphurised Diels-Alder adduct, an alkyl sulphenyl N'N-dialkyl dithiocarbamates; or mixtures thereof. In one embodiment the sulphurised olefin includes an olefin derived from propylene, isobutylene, pentene or mixtures thereof.

In one embodiment the extreme pressure agent sulphur-containing compound comprising a dimercaptothiadiazole or derivative, or mixtures thereof. Examples of the dimercaptothiadiazole include 2,5-dimercapto-1,3-4-thiadiazole or a hydrocarbyl-substituted 2,5-dimercapto-1,3-4-thiadiazole, or oligomers thereof. The oligomers of hydrocarbyl-substituted 2,5-dimercapto-1,3-4-thiadiazole typically form by forming a sulphur-sulphur bond between 2,5-dimercapto-1,3-4-thiadiazole units to form derivatives or oligomers of two or more of said thiadiazole units. Suitable 2,5-dimercapto-1,3-4-thiadiazole derived compounds include 2,5-bis(tert-nonyldithio)-1,3,4-thiadiazole or 2-tert-nonyldithio-5-mercapto-1,3,4-thiadiazole.

The number of carbon atoms on the hydrocarbyl substituents of the hydrocarbyl-substituted 2,5-dimercapto-1,3-4-thiadiazole typically include 1 to 30, or 2 to 20, or 3 to 16.

In one embodiment the extreme pressure agent includes a boron-containing compound. The boron-containing compound includes a borate ester, a borate alcohol, a borated dispersant or mixtures thereof.

In one embodiment the boron-containing compound is a borate ester or a borate alcohol. The borate ester or borate alcohol compounds are substantially the same except the borate alcohol has at least one hydroxyl group that is not esterified. Therefore, as used herein the term "borate ester" is used to refer to either borate ester or borate alcohol.

The borate ester may be prepared by the reaction of a boron compound and at least one compound selected from epoxy compounds, halohydrin compounds, epihalohydrin compounds, alcohols and mixtures thereof. The alcohols include dihydric alcohols, trihydric alcohols or higher alcohols, with the proviso for one embodiment that hydroxyl groups are on adjacent carbon atoms i.e. vicinal. Hereinafter "epoxy compounds" is used when referring to "at least one compound selected from epoxy compounds, halohydrin compounds, epihalohydrin compounds and mixtures thereof"

Boron compounds suitable for preparing the borate ester include the various forms selected from the group consisting of boric acid (including metaboric acid, $HBO_2$, orthoboric acid, $H_3BO_3$, and tetraboric acid, $H_2B_4O_7$), boric oxide, boron trioxide and alkyl borates. The borate ester may also be prepared from boron halides.

In one embodiment suitable borate ester compounds include tripropyl borate, tributyl borate, tripentyl borate, trihexyl borate, triheptyl borate, trioctyl borate, trinonyl borate and tridecyl borate.

In one embodiment the borate ester compounds include tributyl borate, tri-2-ethylhexyl borate or mixtures thereof.

In one embodiment, the boron-containing compound is a borated dispersant, typically derived from an N-substituted long chain alkenyl succinimide. In one embodiment the borated dispersant includes a polyisobutylene succinimide. Borated dispersant are described in more detail in U.S. Pat. No. 3,087,936; and U.S. Pat. No. 3,254,025.

In one embodiment the borated dispersant is used in combination with a sulphur-containing compound or a borated ester.

In one embodiment the extreme pressure agent is other than a borated dispersant.

The number average molecular weight of the hydrocarbon from which the long chain alkenyl group was derived includes ranges of 350 to 5000, or 500 to 3000, or 550 to 1500. The long chain alkenyl group may have a number average molecular weight of 550, or 750, or 950 to 1000.

The N-substituted long chain alkenyl succinimides are borated using a variety of agents including boric acid (for example, metaboric acid, $HBO_2$, orthoboric acid, $H_3BO_3$, and tetraboric acid, $H_2B_4O_7$), boric oxide, boron trioxide, and alkyl borates described in formulae (I) to (VI) above. In one embodiment the borating agent is boric acid which may be used alone or in combination with other borating agents.

The borated dispersant may be prepared by blending the boron compound and the N-substituted long chain alkenyl succinimides and heating them at a suitable temperature, such as, 80° C. to 250° C., or 90° C. to 230° C., or 100° C. to 210° C., until the desired reaction has occurred. The molar ratio of the boron compounds to the N-substituted long chain alkenyl succinimides may have ranges including 10:1 to 1:4, or 4:1 to 1:3, or 1:2. An inert liquid may be used in performing the reaction. The liquid may include toluene, xylene, chlorobenzene, dimethylformamide or mixtures thereof.

Friction modifiers (other than (a) a borated phospholipid, and (b) an amine salt of a phosphoric acid ester) include fatty amines, esters such as borated glycerol esters, fatty phosphites, fatty acid amides, fatty epoxides, borated fatty epoxides, alkoxylated fatty amines, borated alkoxylated fatty amines, metal salts of fatty acids, or fatty imidazolines, condensation products of carboxylic acids and polyalkylene-polyamines.

In one embodiment the lubricating composition may contain phosphorus- or sulphur-containing antiwear agents other than compounds described as an extreme pressure agent of the amine salt of a phosphoric acid ester described above. Examples of the antiwear agent may include non-ionic phosphorus compound (typically compounds having phosphorus atoms with an oxidation state of +3 or +5), a metal dialkyldithiophosphate (typically zinc dialkyldithiophosphates), a metal mono- or di-alkylphosphate (typically zinc phosphates), or mixtures thereof.

The non-ionic phosphorus compound includes a phosphite ester, a phosphate ester, or mixtures thereof. A more detailed description of the non-ionic phosphorus compound include column 9, line 48 to column 11, line 8 of U.S. Pat. No. 6,103,673.

In one embodiment the amine salt of a phosphorus compound other than those disclosed above, is described in U.S. Pat. No. 3,197,405. In one embodiment the amine salt of a phosphorus compound other than those disclosed above, may be prepared by any one of examples 1 to 25 of U.S. Pat. No. 3,197,405.

In one embodiment the amine salt of a phosphorus compound other than those disclosed above, is a reaction product prepared from a dithiophosphoric acid is reacting with an epoxide or a glycol. This reaction product is further reacted with a phosphorus acid, anhydride, or lower ester (where "lower" signifies 1 to 8, or 1 to 6, or 1 to 4, or 1 to 2 carbon atoms in the alcohol-derived portion of the ester). The epoxide includes an aliphatic epoxide or a styrene oxide. Examples of useful epoxides include ethylene oxide, propylene oxide, butene oxide, octene oxide, dodecene oxide, styrene oxide and the like. In one embodiment the epoxide is propylene oxide. The glycols include aliphatic glycols having 1 to 12, or 2 to 6, or 2 to 3 carbon atoms. The dithiophosphoric acids, glycols, epoxides, inorganic phosphorus reagents and methods of reacting the same are described in U.S. Pat. Nos. 3,197,405 and 3,544,465. The resulting acids are then salted with amines.

An example of suitable dithiophosphoric acid based product is prepared by adding phosphorus pentoxide (about 64 grams) at 58° C. over a period of 45 minutes to 514 grams of hydroxypropyl O,O-di(1,3-dimethylbutyl)phosphorodithioate (prepared by reacting di(1,3-dimethylbutyl)-phosphorodithioic acid with 1.3 moles of propylene oxide at 25° C.). The mixture is heated at 75° C. for 2.5 hours, mixed with a diatomaceous earth and filtered at 70° C. The filtrate contains 11.8% by weight phosphorus, 15.2% by weight sulphur, and an acid number of 87 (bromophenol blue).

In one embodiment the lubricating composition of the invention further includes a dispersant. The dispersant may be a succinimide dispersant (for example N-substituted long chain alkenyl succinimides), a Mannich dispersant, an ester-containing dispersant, a condensation product of a fatty hydrocarbyl monocarboxylic acylating agent with an amine or ammonia, an alkyl amino phenol dispersant, a hydrocarbyl-amine dispersant, a polyether dispersant or a polyetheramine dispersant.

In one embodiment the succinimide dispersant includes a polyisobutylene-substituted succinimide, wherein the polyisobutylene-substituent has a number average molecular weight of 400 to 5000.

Succinimide dispersants and their methods of preparation are more fully described in U.S. Pat. Nos. 4,234,435 and 3,172,892.

Suitable ester-containing dispersants are typically high molecular weight esters. These materials are described in more detail in U.S. Pat. No. 3,381,022.

In one embodiment the dispersant includes a borated dispersant. Typically the borated dispersant includes asuccinimide dispersant including a polyisobutylene succinimide, wherein the polyisobutylene has a number average molecular weight of 400 to 5000. Borated dispersants are described in more detail above within the extreme pressure agent description.

Dispersant viscosity modifiers (often referred to as DVMs) include functionalised polyolefins, for example, ethylene-propylene copolymers that have been functionalized with the reaction product of maleic anhydride and an amine, a polymethacrylate functionalised with an amine, or styrene-maleic anhydride copolymers reacted with an amine may also be used in the composition of the invention.

Corrosion inhibitors include octylamine octanoate, condensation products of dodecenyl succinic acid or anhydride and/or a fatty acid such as oleic acid with a polyamine.

Metal deactivators include derivatives of benzotriazoles (typically tolyltriazole), 1,2,4-triazoles, benzimidazoles, 2-alkyldithiobenzimidazoles or 2-alkyldithiobenzothiazoles. The metal deactivators may also be described as corrosion inhibitors.

Foam inhibitors include copolymers of ethyl acrylate and 2-ethylhexylacrylate and optionally vinyl acetate.

Demulsifiers include trialkyl phosphates, and various polymers and copolymers of ethylene glycol, ethylene oxide, propylene oxide, or mixtures thereof.

Pour point depressants including esters of maleic anhydride-styrene, polymethacrylates, polyacrylates or polyacrylamides.

Seal swell agents including Exxon Necton-37™ (FN 1380) and Exxon Mineral Seal Oil™ (FN 3200).

Industrial Application

The limited slip differential typically incorporates a self-contained lubricant supply isolated from the lubricant disposed in the differential housing or carrier. The self-contained lubricant of the limited slip differential is generally different from the lubricant supplied to a manual transmission or an automatic transmission fluid. In both the manual and automatic transmission systems not comprising a limited slip differential one lubricant is sufficient to lubricate all of the transmission constituents.

The lubricating composition suitable for the limited slip differential may have a sulphur content in the range of 0.3 wt % to 5 wt %, or 0.5 wt % to 5 wt %, or 0.5 wt % to 3 wt % or 0.8 wt % to 2.5 wt %, 1 wt % to 2 wt %.

In one embodiment the lubricating composition suitable for the limited slip differential is a fully formulated fluid.

In one embodiment the lubricating composition suitable for the limited slip differential is a top treat concentrate.

When the lubricating composition is in the form of a top treat concentrate, the concentrate may be added at 0.2 wt % to 10 wt %, or 0.5 wt % to 7 wt % relative to the amount of lubricant in a limited slip differential.

In one embodiment the lubricating composition consists of or consists essentially of (a) a borated phospholipid, (b) an amine salt of a phosphoric acid ester, (c) an oil of lubricating viscosity, and optionally a viscosity modifier. Typically a lubricating composition of this type may only be a top treat concentrate.

The following examples provide illustrations of the invention. These examples are non exhaustive and are not intended to limit the scope of the invention.

EXAMPLES

Comparative Example 1 (CE1): is a commercially available 75W-90 gear oil suitable for a limited slip differential containing 0 wt % of a borated lecithin (or other borated phospholipid), and 0 wt % of amine salt of a phosphorus acid ester derived from a reaction product of a $C_{18}$ alkylated phosphoric acid with a Primene® 81R (or other amine salt of a phosphoric acid ester).

Comparative Example 2 (CE2): is similar to CE1 except the gear oil is top treated with 2.5 wt % of a borated lecithin.

Comparative Example 3 (CE3): is similar to CE1 except the gear oil is top treated with 2.25 wt % of an amine salt of a phosphorus acid ester derived from a reaction product of a $C_{18}$ alkylated phosphoric acid with a Primene® 81R.

Comparative Example 4 (CE4): is similar to CE1 except the gear oil is top treated with 3.38 wt % of phosphorus-containing antiwear agents. The antiwear agents include (i) 2.25 wt % of an amine salt of a phosphorus acid ester derived from a reaction product of a $C_{18}$ alkylated phosphoric acid with a Primene® 81R, and (ii) 1.13 wt % of a $C_{16-18}$ alkyl phosphite.

Example 1 (EX1): A commercially available gear oil (suitable for a limited slip differential) similar to CE1 is top treated with a fluid containing (i) 1.75 wt % of a borated lecithin, and (ii) 0.5 wt % of an amine salt of a phosphorus acid ester derived from a reaction product of a $C_{18}$ alkylated phosphoric acid with a Primene® 81R.

Comparative Example 5 (CE5): is a commercially available gear oil comprising a different additive package to CE1. The gear oil is suitable for a limited slip differential containing 0 wt % of a borated lecithin (or other borated phospholipid), and 0 wt % of amine salt of a phosphorus acid ester derived from a reaction product of a $C_{18}$ alkylated phosphoric acid with a Primene® 81R (or other amine salt of a phosphoric acid ester).

Comparative Example 6 (CE6): is similar to CE5 except the gear oil is top treated with a fluid containing (i) 2.25 wt % of an amine salt of a phosphorus acid ester derived from a reaction product of a $C_{18}$ alkylated phosphoric acid with a Primene® 81R, and (ii) 1.13 wt % of a $C_{16-18}$ alkyl phosphite.

Example 6 (EX6): is similar to CE5 except the gear oil is top treated with a fluid containing (i) 1.75 wt % of a borated lecithin, and (ii) 0.5 wt % of an amine salt of a phosphorus acid ester derived from a reaction product of a $C_{1-8}$ alkylated phosphoric acid with a Primene® 81R The oxidative stability of each example is determined by employing the methodology of CEC-L-48-A-00.

The kinematic viscosity for each example (EX1 to EX3, and CE1 to CE6) is determined at 100° C. by employing the methodology of ASTM method D445. The reported results have units $mm^2/s$ (or cSt).

The change in total acid number (i.e., TAN, with units mg of KOH/g) for each example (EX1 to EX3, and CE1 to CE6) is determined by the methodology of ASTM D664-06a.

The examples prepared (EX1 to EX3, and CE1 to CE6) are evaluated using a mu-PVT (mu, friction coefficient obtained at varying Pressures, Velocities and Temperatures) friction screen test on a Low Speed SAE #2 test machine. This friction screen test utilises a Dana Model 80 plate configuration with Miba MC-631 friction material with the following plate configuration (S-F-S-F-S-F-S-F-S, where S is a steel plate, and F is a friction plate) thereby producing 8 active friction surfaces. The test runs through a map of varying apply pressures and plate differential speeds while holding the temperature constant at 50° C. There are six apply pressure settings of 190, 380, 570, 760, 950 and 1075 kPa. At each apply pressure setting, four distinct plate differential speeds of 15, 50, 85 and 120 rpm are utilised. At each plate differential speed, twenty five repeat cycles are conducted. Each test has a total of 600 cycles (six pressures×four speeds×twenty-five cycles). A 600 cycle mu-PVT or friction map is conducted before and after a durability cycle to assess the change in friction performance. The durability cycle consists of a constant apply pressure of 570 kPa at a fluid temperature of 80° C. and cycling the plate differential speed between 120 and 0 rpm. One complete cycle consists of 5 seconds at 0 rpm and 5 seconds at 120 rpm. This is repeated for a total of 2500 cycles. The primary measurement is an NVH rating that depicts the variation in the torque signal during each discrete speed event or the difference between the minimum and maximum friction coefficient obtained during the event. This measurement assigns a number to the magnitude of the torque signal variation according to the following table:

| Torque Signal Variation | NVH Rating |
|---|---|
| Between 0 and 0.02 Coefficient of Friction Units | 0 |
| Between 0.02 and 0.04 Coefficient of Friction Units | 1 |
| Between 0.04 and 0.06 Coefficient of Friction Units | 2 |
| Between 0.06 and 0.08 Coefficient of Friction Units | 3 |
| Between 0.08 and 0.10 Coefficient of Friction Units | 4 |
| Between 0.10 and 0.12 Coefficient of Friction Units | 5 |
| Between 0.12 and 0.14 Coefficient of Friction Units | 6 |
| Between 0.14 and 0.16 Coefficient of Friction Units | 7 |
| Greater than 0.16 | 8 |

These ratings are summed up for all cycles completed at one apply pressure and speed setting and then for the entire test. The maximum NVH rating is 9600 points (6 pressures×4 speeds×25 repeats×8 NVH Rating=4800, ×2 for pre and post durability evaluation=9600). This would be considered very poor friction performance. The minimum NVH rating is 0 points. This would be considered excellent friction performance. The results obtained for EX1 to EX3 and CE1 to CE6 are shown in the Table below. The results obtained for the tests described above are:

| | Oxidative Stability Tube Rating | Spot Rating | Kinematic Viscosity Increase | Change in TAN | Post Durability NVH Rating |
|---|---|---|---|---|---|
| CE1 | C | 80 | 122.6 | 5.2 | Failed* |
| CE2 | D | 100 | 153 | 17.2 | 186 |
| CE3 | not run | not run | 126.7 | 5.2 | 526 |
| CE4 | not run | not run | 300.3 | 9.3 | not run |
| EX1 | D | 100 | 106.2 | 9 | 192 |
| EX2 | not run | not run | 115.7 | 9.8 | 219 |
| CE5 | not run | not run | 113.6 | 5.5 | 4723 |
| CE6 | not run | not run | 214.1 | 12.2 | 830 |
| EX3 | not run | not run | 148.3 | 4.9 | 202 |

Footnote to Table:
*CE1 failed Post Durability NVH Rating because the test was stopped before completion because extremely high torque caused equipment failure.

The data obtained from the tests indicates that the lubricating composition of the invention is capable of providing a limited slip differential with an acceptable level of at least one of (i) lubricant thermal stability, (ii) lubricant oxidative stability, (iii) high static coefficient of friction, (iv) fuel economy, (v) deposit control, (vi) seal compatibility, and (vii) low tendency towards post durability NVH often manifested as chatter. Typically the lubricating composition of the invention is capable of providing both oxidative stability and low tendency towards post durability NVH often manifested as chatter, and optionally any of lubricant thermal stability, high static coefficient of friction, fuel economy, deposit control, or seal compatibility.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(i) hydrocarbon substituents, that is, aliphatic (e.g., alkyl or alkenyl), alicyclic (e.g., cycloalkyl, cycloalkenyl) substituents, and aromatic-, aliphatic and alicyclic-substituted aromatic substituents, as well as cyclic substituents wherein the ring is completed through another portion of the molecule (e.g., two substituents together form a ring);

(ii) substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulphoxy);

(iii) hetero substituents, that is, substituents which, while having a predominantly hydrocarbon character, in the context of this invention, contain other than carbon in a ring or chain otherwise composed of carbon atoms; and (iv) heteroatoms include sulphur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A method of lubricating a limited slip differential comprising supplying to the limited slip differential a lubricating composition comprising (a) 0.05 wt % to 6 wt % of a borated phospholipid, (b) 0.01 wt % to 5 wt % of an amine salt of a phosphoric acid ester, and (c) an oil of lubricating viscosity.

2. The method of claim 1, wherein the lubricating composition is free of molybdenum-containing additives.

3. The method of claim 1, wherein the borated phospholipid is a borated lecithin or a borated cephalin.

4. The method of claim 1, wherein the borated phospholipid is a borated lecithin.

5. The method of claim 1, wherein the borated phospholipid is present at 0.5 wt % to 3 wt % of the lubricating composition.

6. The method of claim 1, wherein the amine salt of a phosphorus acid ester is a reaction product of a $C_{12-20}$ alkylated phosphoric acid with a tertiary $C_{11-22}$ alkyl primary amine.

7. The method of claim 1, wherein the amine salt of a phosphorus acid ester is present at 0.01 wt % to 2 wt % of the lubricating composition.

8. The method of claim 1, wherein the amine salt of a phosphoric acid ester is present at 10 wt % to 50 wt % of the total combined amount of (a) and (b); and wherein the borated phospholipid is present at 50 wt % to 90 wt % of the total combined amount of (a) and (b).

9. The method of claim 1, wherein the amine salt of a phosphoric acid ester is present at 25 wt % to 40 wt % of the total combined amount of (a) and (b); and wherein the borated phospholipid is present at 60 wt % to 75 wt % of the total combined amount of (a) and (b).

10. The method of claim 1 wherein the lubricating composition further comprises a viscosity modifier.

11. The method of claim 1, wherein the viscosity modifier is present at 10 to 50 wt % of the lubricating composition.

12. The method of claim 1, wherein the viscosity modifier is selected from the group consisting of (a) a polymethacrylate, (b) a copolymer of (i) a vinyl aromatic monomer; and (ii) an unsaturated carboxylic acid, anhydride, or derivatives thereof, (c) an interpolymer of (i) an alpha-olefin; and (ii) an unsaturated carboxylic acid, anhydride, or derivatives thereof, and (d) mixtures thereof.

* * * * *